US011466482B2

(12) United States Patent
Izumi et al.

(10) Patent No.: US 11,466,482 B2
(45) Date of Patent: Oct. 11, 2022

(54) DOOR LOCK DEVICE FOR VEHICLE

(71) Applicant: AISIN CORPORATION, Kariya (JP)

(72) Inventors: Shogo Izumi, Kariya (JP); Kazunori Kojima, Kariya (JP); Yoshiki Odaka, Kariya (JP)

(73) Assignee: AISIN CORPORATION, Aichi (JP)

( * ) Notice: Subject to any disclaimer, the term of this patent is extended or adjusted under 35 U.S.C. 154(b) by 404 days.

(21) Appl. No.: 16/690,381

(22) Filed: Nov. 21, 2019

(65) Prior Publication Data

US 2020/0165845 A1 May 28, 2020

(30) Foreign Application Priority Data

Nov. 22, 2018 (JP) ..... JP2018-219092

(51) Int. Cl.
*E05B 79/20* (2014.01)
*E05C 3/16* (2006.01)
(Continued)

(52) U.S. Cl.
CPC ..... *E05B 79/20* (2013.01); *E05B 77/02* (2013.01); *E05B 85/02* (2013.01); *E05C 3/167* (2013.01)

(58) Field of Classification Search
CPC ..... E05B 79/20; E05B 77/02; E05B 77/04; E05B 77/10; E05B 85/02; E05B 85/20;
(Continued)

(56) References Cited

U.S. PATENT DOCUMENTS 8,851,533 B2 * 10/2014 Akizuki ..... E05B 77/26 292/201
2006/0186674 A1 8/2006 Suzumura et al.
(Continued)

FOREIGN PATENT DOCUMENTS

JP 2006266028 A 10/2006
JP 2015101863 A 6/2015
(Continued)

OTHER PUBLICATIONS

Numbered Paragraphs of Detailed Description of WO2012063722 A1 (Year: 2012).*

*Primary Examiner* — Christine M Mills
*Assistant Examiner* — Christopher F Callahan
(74) *Attorney, Agent, or Firm* — Buchanan Ingersoll & Rooney PC

(57) ABSTRACT

A door lock device for a vehicle includes: a support member; a latch supported to be rotatable around a first shaft member supported by the support member and rotating in a first direction and engaging with a striker provided in a vehicle main body when a vehicle door is closed; a pawl supported to be rotatable around a second shaft member supported by the support member and restricting rotation of the latch in a second direction by engaging with the latch engaged with the striker; and an elastic member having one and other end portions and elastically deformed by an external force, in which in a state where the elastic member is elastically deformed, the one end portion engages with the pawl, the other end portion is supported by the support member, and an elastic force is applied to the pawl to bias the pawl to the latch side.

3 Claims, 6 Drawing Sheets

(51) Int. Cl.
*E05B 77/02* (2014.01)
*E05B 85/02* (2014.01)

(58) Field of Classification Search
CPC ..... E05B 85/24; E05B 85/243; E05B 85/26; E05C 3/167; Y10T 292/1047; Y10T 292/1082; Y10T 292/22; Y10T 292/23; Y10T 292/53; Y10T 292/201; Y10T 292/216
See application file for complete search history.

(56) References Cited

U.S. PATENT DOCUMENTS

2016/0290021 A1 10/2016 Nishio
2018/0274272 A1* 9/2018 Woo ..... E05B 83/36

FOREIGN PATENT DOCUMENTS

WO WO-02079598 A2 * 10/2002 ..... E05B 17/08
WO WO-2012063722 A1 * 5/2012 ..... E05B 81/06

* cited by examiner

DOOR LOCK DEVICE FOR VEHICLE

CROSS REFERENCE TO RELATED APPLICATIONS

This application is based on and claims priority under 35 U.S.C. § 119 to Japanese Patent Application 2018-219092, filed on Nov. 22, 2018, the entire contents of which are incorporated herein by reference.

TECHNICAL FIELD

This disclosure relates to a door lock device for a vehicle.

BACKGROUND DISCUSSION

Vehicle door lock devices (door lock devices for a vehicle) are described in, for example, JP 2015-101863A (Reference 1) and JP 2006-266028A (Reference 2) below. These vehicle door locks are provided with various levers such as a latch and a pawl. These levers are accommodated in a substantially box-shaped support member (housing).

The latch is supported so as to be rotatable around a shaft member supported by the housing. When a vehicle door is closed, the latch rotates in a predetermined first direction around the shaft member while engaging with a striker provided in the main body of a vehicle. The pawl is supported so as to be rotatable around the shaft member supported by the housing. The vehicle door lock device is provided with a pawl spring (torsion coil spring). One end portion of the pawl spring is locked to the pawl and the other end portion of the pawl spring is locked to the housing. The pawl is biased to the latch side by the pawl spring. The pawl engages with the latch engaged with the striker and restricts latch rotation in a second direction opposite to the first direction. As a result, a state where the vehicle door is closed is held.

When a door handle connected to the pawl is pulled, the pawl rotates to the side opposite to the direction in which the pawl is biased by the pawl spring. As a result, the pawl is disengaged from the latch and the latch can be rotated in the second direction. In other words, the vehicle door can be opened.

The housing has a first support member (body) made of a synthetic resin and a second support member (sub-base plate) made of a metal. In Reference 1, the other end portion of the pawl spring is locked to the first support member. The pawl is not biased to the latch side as intended in a case where the first support member is damaged as a result of impact application to the vehicle door (or the vehicle door lock device). In Reference 2, the other end portion of the pawl spring is locked to the second support member. Even in the event of impact application to the vehicle door (or the vehicle door lock device), the second support member made of a metal is less likely to be damaged than the first support member made of a synthetic resin. Accordingly, the pawl can be continuously biased to the latch side as intended. In general, the second support member is formed by press working being performed on a metal plate. In a case where a locking portion to which the other end portion of the pawl spring is locked is formed by press working being performed on a metal plate, the manufacturing accuracy (accuracy in terms of dimension and position) of the locking portion is lower than in a case where the locking portion is made of a synthetic resin. Accordingly, variations in the biasing force of the pawl are larger than in the vehicle door lock device of Reference 1.

Thus, a need exists for a vehicle door lock device which is not susceptible to the drawback mentioned above.

SUMMARY

A vehicle door lock device according to an aspect of this disclosure includes a support member, a latch supported to be rotatable around a first shaft member supported by the support member and rotating in a predetermined first direction and engaging with a striker provided in a main body of a vehicle when the vehicle door is closed, a pawl supported to be rotatable around a second shaft member supported by the support member and restricting rotation of the latch in a second direction opposite to the first direction by engaging with the latch engaged with the striker, and an elastic member having one end portion and the other end portion and elastically deformed by an external force in a predetermined direction applied to the one end portion and the other end portion, in which in a state where the elastic member is elastically deformed, the one end portion engages with the pawl, the other end portion is supported by the support member, and an elastic force of the elastic member is applied to the pawl to bias the pawl to the latch side. The support member has a first support member made of a synthetic resin and a second support member made of a metal. The first support member has a first locking portion (a first engagement portion) to (with) which the other end portion of the elastic member is locked (engages). The second support member has a second locking portion (a second engagement portion) provided at a position separated in a direction in which the first locking portion receives the elastic force from the elastic member when viewed from the first locking portion.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
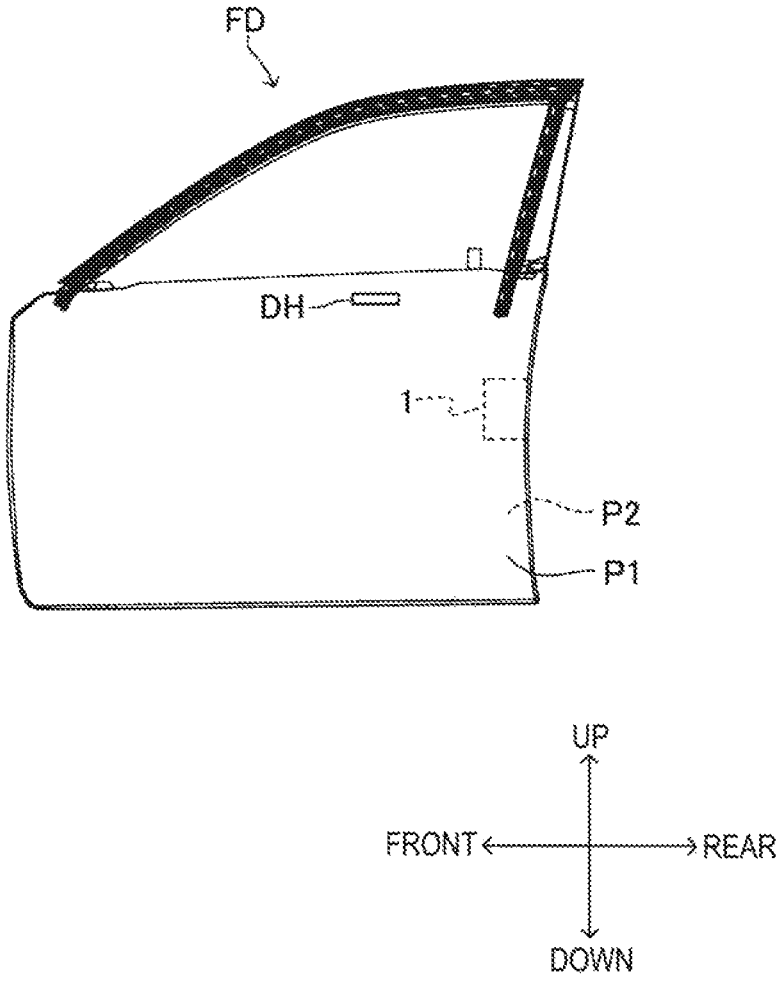
FIG. 1 is a side view in which the right front door of a vehicle to which a vehicle door lock device according to an embodiment disclosed here is assembled is viewed from the inner side of the passenger compartment.

Hereinafter, a vehicle door lock device 1 according to an embodiment disclosed here will be described. As illustrated in FIG. 1, the vehicle door lock device 1 is applied to, for example, a front door FD on the right side of a vehicle. The front door FD has a front side end surface that is assembled to an entrance via a hinge (not illustrated) and the entrance is provided in a side surface portion of the main body portion of the vehicle. The front door FD opens/closes the entrance of the vehicle by rotating around the axis of the hinge. Various directions in the following description represent directions in a state where the front door FD is closed. The front door FD corresponds to the vehicle door disclosed here.

Figure 2:
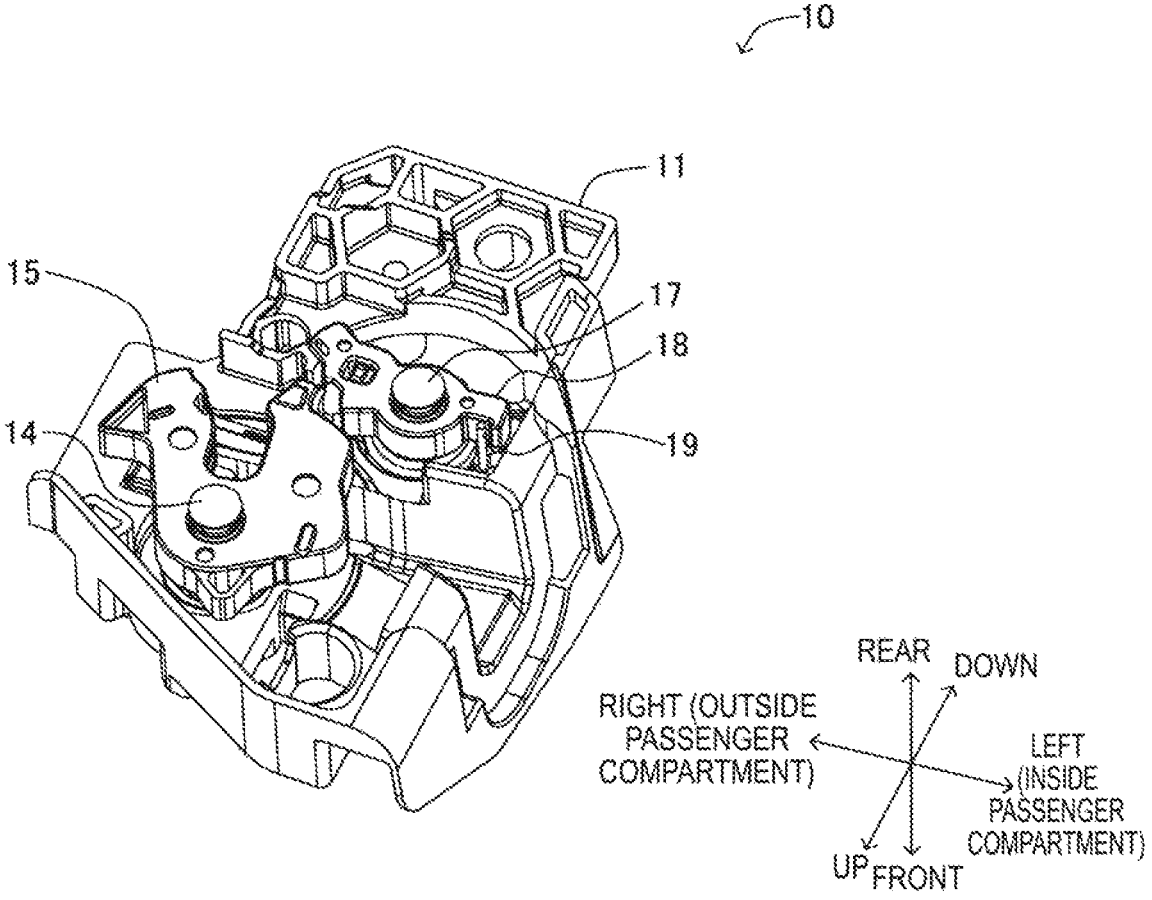
FIG. 2 is a perspective view of a latch mechanism as viewed from diagonally above and from the rear.
Figure 3:
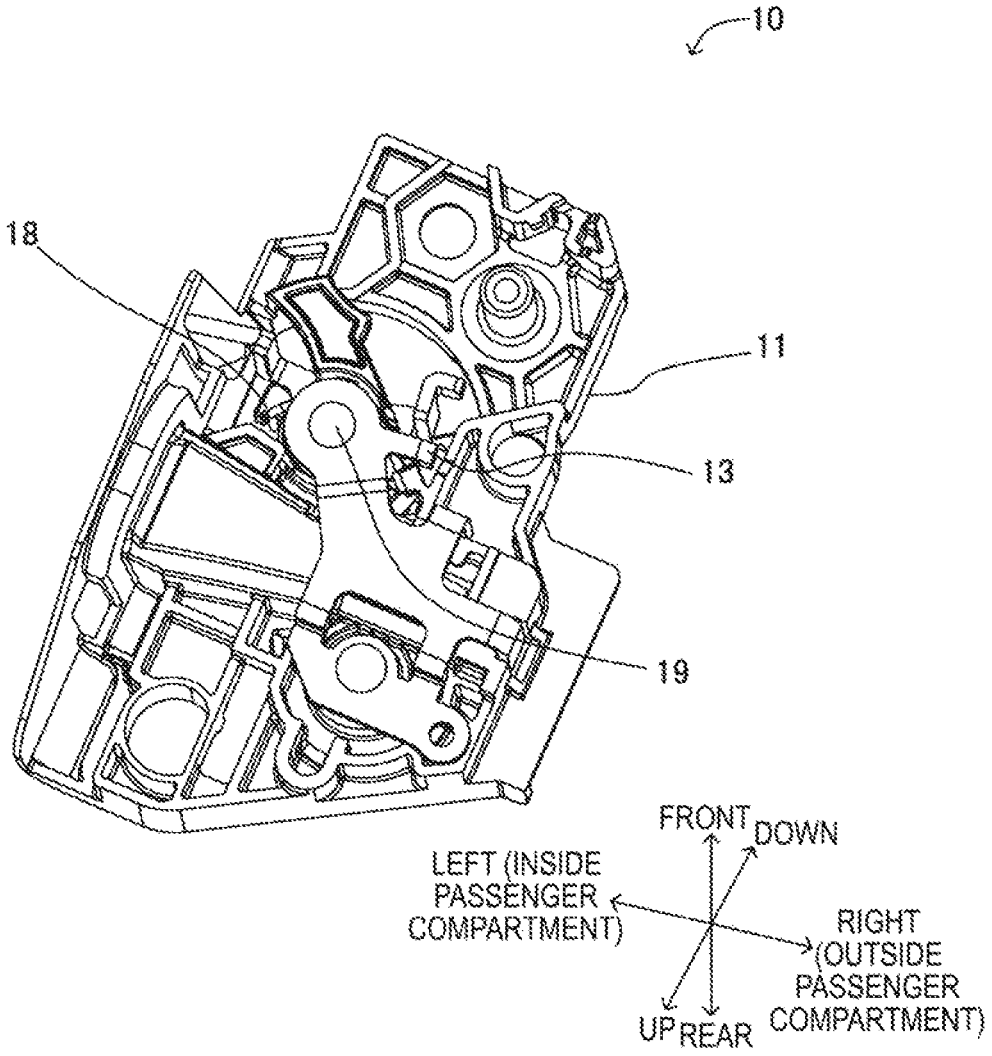
FIG. 3 is a perspective view of the latch mechanism as viewed from diagonally above and from the front.
Figure 4:
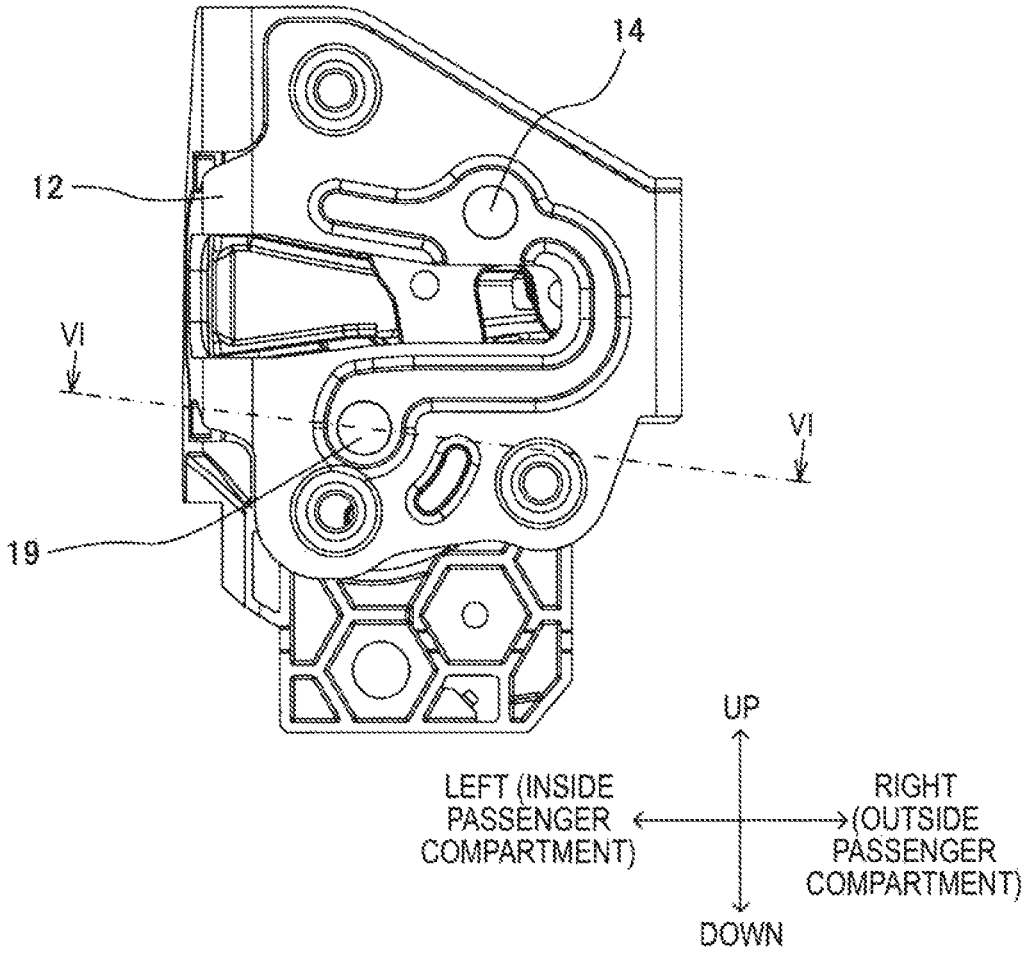
FIG. 4 is a front view of the latch mechanism as viewed from the rear.

The vehicle door lock device 1 is disposed between an inner panel P1 (passenger compartment inner side panel) and an outer panel P2 (passenger compartment outer side panel) of the front door FD. The vehicle door lock device 1 is provided with a latch mechanism 10 illustrated in FIGS. 2 to 4. The latch mechanism 10 holds a state where the front door FD is closed. The vehicle door lock device 1 is provided with not only the latch mechanism 10 but also an open link mechanism as a device opening the front door FD that is closed by transmitting the operation force of a door handle DH to the latch mechanism 10. This open link mechanism is not directly related to this disclosure, and thus the latch mechanism 10 will be described and the open link mechanism will not be described below.

Figure 5:
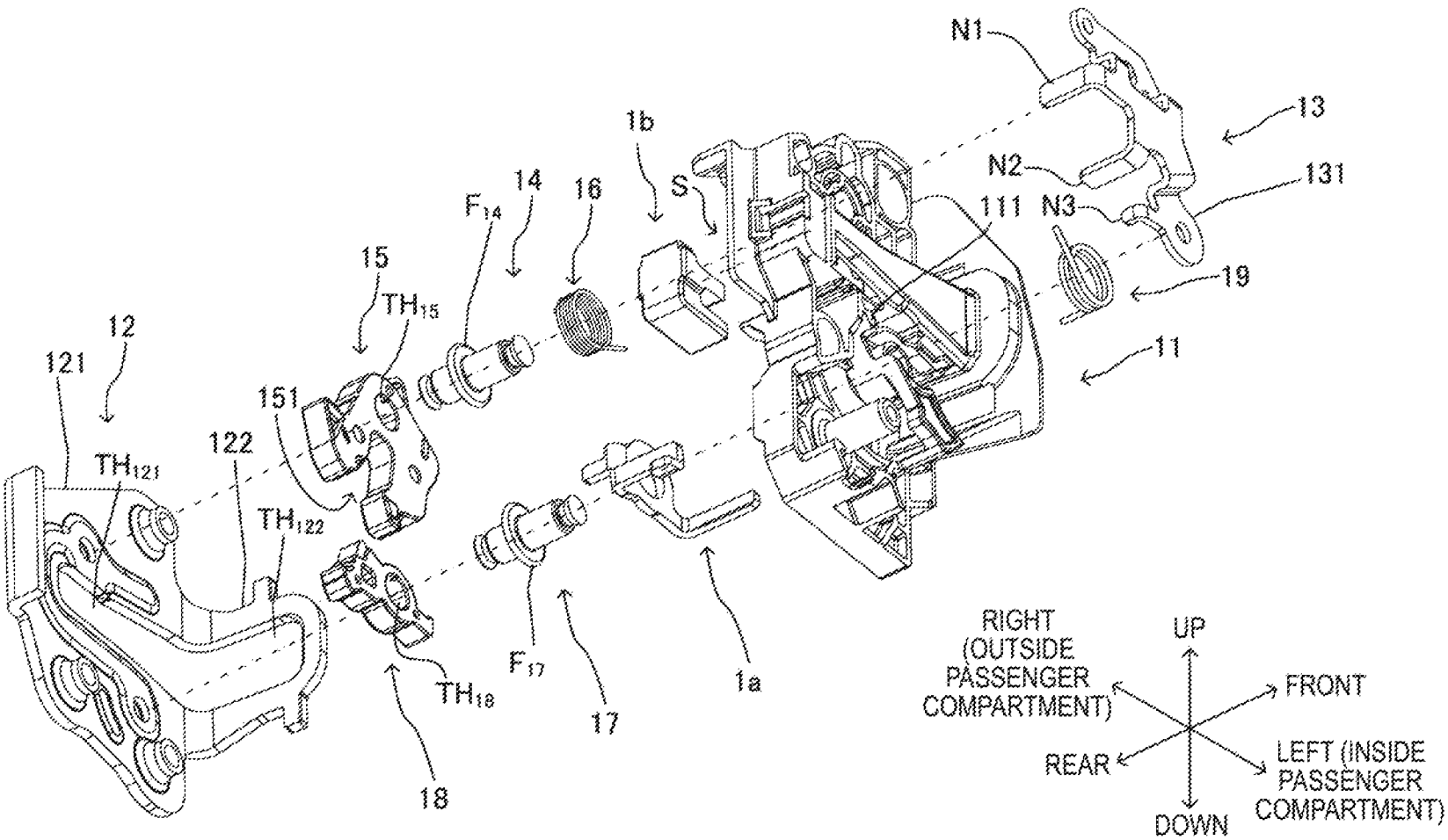
FIG. 5 is an exploded perspective view of the latch mechanism.

As illustrated in FIG. 5, the latch mechanism 10 is provided with a body 11, a base plate 12, a sub-base plate 13, a latch shaft 14, a latch 15, a latch spring 16, a pawl shaft 17, a pawl 18, a pawl spring 19, a lift lever 1*a*, and a cushion 1*b*. The body 11, the sub-base plate 13, and the base plate 12 correspond to the first support member, the second support member, and the third support member disclosed here, respectively. The latch shaft 14 and the pawl shaft 17 correspond to the first shaft member and the second shaft member disclosed here, respectively. The base plate 12 is not illustrated in FIG. 2.

The body 11 is made of a synthetic resin. The body 11 is a substantially box-shaped member opened rearward. In other words, the body 11 has a bottom wall portion perpendicular to the front-rear direction and a peripheral wall portion surrounding a space S on the rear side of the bottom wall portion. The peripheral wall portion is a wall portion substantially perpendicular to the bottom wall portion. Formed in the bottom wall portion are a through hole, a wall portion (rib) perpendicular to a bottom wall surface, a recessed portion, a projection portion, and the like. Each component to be described later is supported by these parts.

The base plate 12 is made of a metal. The base plate 12 has a rear wall portion 121 perpendicular to the front-rear direction and a side wall portion 122 extending forward from the left end portion of the rear wall portion 121. A through hole $TH_{121}$ extending in the left-right direction is formed in the substantially middle portion of the rear wall portion 121 in the vertical direction. The right end of the through hole $TH_{121}$ is positioned slightly to the left of the right end of the rear wall portion 121. The left end of the through hole $TH_{121}$ coincides with the left end of the rear wall portion 121. A through hole $TH_{122}$ extending in the front-rear direction is formed in the substantially middle portion of the side wall portion 122 in the vertical direction. The front end of the through hole $TH_{122}$ is positioned slightly behind the front end of the side wall portion 122. The rear end of the through hole $TH_{122}$ coincides with the rear end of the side wall portion 122. The position of the left end of the through hole $TH_{121}$ coincides with the position of the rear end of the through hole $TH_{122}$. In other words, the through hole $TH_{121}$ and the through hole $TH_{122}$ communicate with each other. A striker provided in the peripheral edge portion of the entrance of the vehicle main body is capable of entering the space S through the through hole $TH_{121}$ and the through hole $TH_{122}$.

The sub-base plate 13 is made of a metal. The sub-base plate 13 has a base portion 131 perpendicular to the front-rear direction and pawl portions N1, N2, and N3 extending rearward from the outer peripheral portion of the base portion 131. The base portion 131 and the pawl portions N1, N2, and N3 are formed by press working being performed on a metal plate.

The base plate 12 is attached to the rear side surface of the body 11 and each component to be described below is accommodated in the space S between the body 11 and the base plate 12. The sub-base plate 13 is attached to the front side surface of the body 11. Each component accommodated in the space S is supported by the base plate 12, the recessed portion and the projection portion provided in the body 11, the sub-base plate 13, and the like.

The latch shaft 14 is a substantially cylindrical member extending in the front-rear direction. A flange portion $F_{14}$ is provided in the longitudinal middle portion of the latch shaft 14. The rear end portion of the latch shaft 14 is supported by the base plate 12 and the front end portion of the latch shaft 14 is supported by the body 11. The latch shaft 14 is positioned slightly above the through hole $TH_{121}$ of the base plate 12.

The latch 15 is a plate-shaped member perpendicular to the front-rear direction, the latch 15 has a cutout portion 151 extending inward from the outer peripheral surface of the latch 15, and the latch 15 is provided with a through hole $TH_{15}$. The rear half portion of the latch shaft 14 (part of the latch shaft 14 that is behind the flange portion $F_{14}$) is inserted in the through hole $TH_{15}$. In other words, the latch 15 is supported so as to be rotatable around the latch shaft 14.

The latch spring 16 is a torsion coil spring. The latch spring 16 is disposed such that the central axis line of the latch spring 16 extends in the front-rear direction. The latch spring 16 is inserted in the front half portion of the latch shaft 14 (part of the latch shaft 14 that is in front of the flange portion $F_{14}$). One end portion of the latch spring 16 is locked to the body 11 and the other end portion of the latch spring 16 is locked to the latch 15. The latch 15 is biased clockwise as viewed from the rear of the front door FD (hereinafter, referred to as a first direction) by the latch spring 16.

The body 11 is provided with a stopper restricting the rotation of the latch 15 in the first direction by the latch spring 16. When the front door FD is open, the rotation of the latch 15 in the first direction is restricted by the stopper. In this state, the distal end portion of the cutout portion 151 of the latch 15 (part positioned on the outer peripheral side of the latch 15) is positioned in front of the through hole $TH_{121}$ of the base plate 12. In other words, in this state, the striker that has entered the space S is capable of entering the cutout portion 151. The rotation position of the latch 15 at this time is called an unlatch position.

Figure 6:
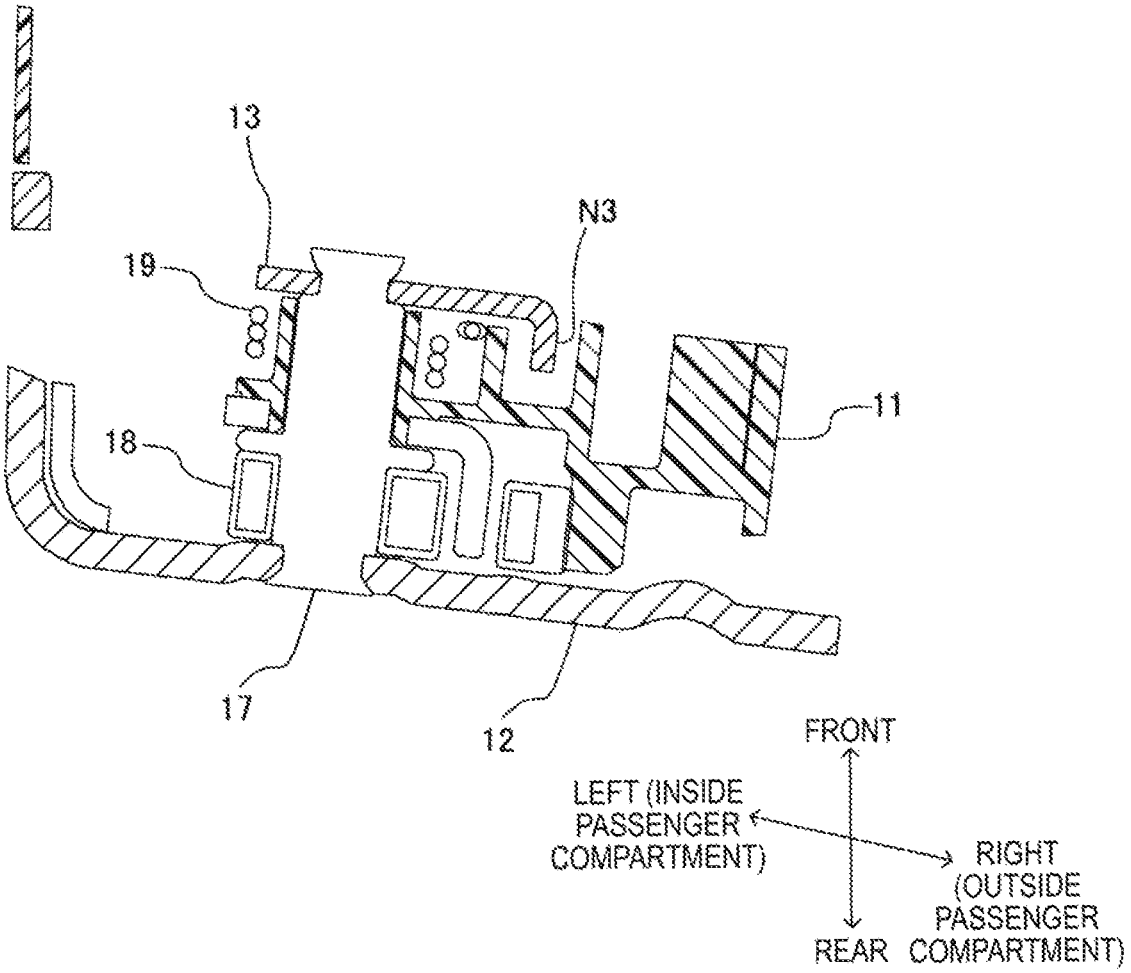
FIG. 6 is a cross-sectional view taken along line VI-VI in FIG. 4.

The pawl shaft 17 is a substantially cylindrical member extending in the front-rear direction. A flange portion $F_{17}$ is provided in the longitudinal middle portion of the pawl shaft 17. The rear end portion of the pawl shaft 17 is supported by the base plate 12 and the front end portion of the pawl shaft 17 is supported by the sub-base plate 13 (see FIG. 6). The pawl shaft 17 is positioned slightly below the through hole $TH_{121}$ of the base plate 12.

The pawl 18 is a substantially rectangular plate-shaped member perpendicular to the front-rear direction. A through hole $TH_{18}$ is formed in the longitudinal middle portion of the pawl 18. The rear half portion of the pawl shaft 17 (part of the pawl shaft 17 that is behind the flange portion $F_{17}$) is inserted in the through hole $TH_{18}$. In other words, the pawl 18 is supported so as to be rotatable around the pawl shaft 17.

The pawl spring 19 is a torsion coil spring. In other words, the pawl spring 19 is a substantially coil-shaped member. The pawl spring 19 is disposed such that the direction of extension of the central axis line of the pawl spring 19 coincides with the front-rear direction. One end portion of the pawl spring 19 extends downward. The other end portion of the pawl spring 19 extends in a straight line in the tangential direction of a coil part. The pawl spring 19 is inserted in the front half portion of the pawl shaft 17 (part of the pawl shaft 17 that is in front of the flange portion $F_{17}$). One end portion of the pawl spring 19 is locked to the outer peripheral surface of one end portion of the pawl 18. The other end portion of the pawl spring 19 is locked to a standing wall portion 111 formed on the front side surface of the body 11. The pawl 18 is biased clockwise as viewed from the rear of the front door FD by the pawl spring 19.

The lift lever 1*a* is supported so as to be rotatable around the pawl shaft 17. The lift lever 1*a* is engaged with the pawl 18. The lift lever 1*a* is connected to the door handle DH (see FIG. 1) via the open link mechanism.

When the rotation position of the latch 15 is at the unlatch position, the front door FD can be opened/closed. When the front door FD is closed from this state, the latch 15 receives the striker in the cutout portion 151. The portion of the cutout portion 151 that abuts against the striker is pressed by the striker. As a result, the latch 15 rotates in a second direction against the biasing force of the latch spring 16. When the entrance reaches a state of being completely closed by the front door FD, the pawl 18 engages with the outer peripheral portion of the latch 15. In other words, the other end portion of the pawl 18 is fitted to the projection portion that is provided in the vicinity of the cutout portion 151 of the latch 15. As a result, the front door FD is held in a closed state. In other words, the pawl 18 restricts the rotation of the latch 15 in the first direction. This rotation position of the latch 15 is called a latch position. In this manner, the front door FD is held in a state where no opening action is possible.

When the front door FD is closed, the impact applied to the latch 15 is absorbed by the cushion 1*b*.

When the door handle DH is pulled with the front door FD closed, the operation force to the door handle DH is transmitted to the lift lever 1*a* via the open link mechanism. As a result, the lift lever 1*a* rotates around the pawl shaft 17 with the pawl shaft 17 and the pawl 18 integrated. As a result, the engagement between the latch 15 and the pawl 18 is released. Then, the latch 15 is biased by the latch spring 16 and rotates in the first direction. As a result, the front door FD can be opened.

Figure 7:
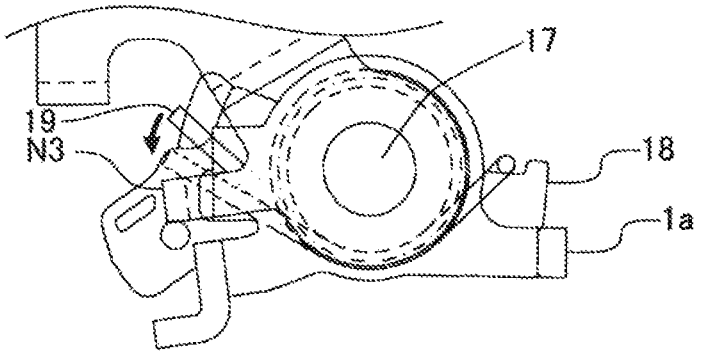
FIG. 7 is a schematic diagram illustrating how the other end portion of a pawl spring is locked.

Usually, the other end portion of the pawl spring 19 is locked to the standing wall portion 111 of the body 11 as described above. The body 11 is made of a synthetic resin (injection-molded article) and the manufacturing accuracy of the body 11 is relatively high. Accordingly, variations in the biasing force of the pawl spring 19 can be suppressed. Here, the pawl portion N3 of the sub-base plate 13 is disposed at a position separated in a direction of the elastic force that the standing wall portion 111 usually receives from the pawl spring 19 (direction opposite to the support reaction force) when viewed from the standing wall portion 111. Even when the standing wall portion 111 of the body 11 made of a synthetic resin is damaged as a result of impact application to the front door FD, one end portion of the pawl spring 19 moves counterclockwise and is locked to the pawl portion N3 insofar as the pawl portion N3 of the sub-base plate 13 made of a metal remains intact (see FIG. 7). Accordingly, even when the standing wall portion 111 is damaged, the pawl 18 is biased by the pawl spring 19 and a state where engagement/disengagement is possible with respect to the latch 15 is maintained. Therefore, according to the present embodiment, variations in the biasing force of the pawl spring 19 can be usually suppressed and it is possible to open/close the front door FD as intended even in a case where the standing wall portion 111 is damaged.

Further, implementation disclosed here is not limited to the above embodiment and various modifications can be made within the object disclosed here.

Although the other end portion of the pawl spring 19 is locked to the standing wall portion 111 in the above embodiment, the locking mode of the other end portion of the pawl spring 19 is not limited to the above embodiment. For example, the body 11 may be provided with a columnar portion, a pawl portion, and the like and the other end portion of the pawl spring 19 may be locked to these parts.

A vehicle door lock device according to an aspect of this disclosure includes a support member, a latch supported to be rotatable around a first shaft member supported by the support member and rotating in a predetermined first direction and engaging with a striker provided in a main body of a vehicle when the vehicle door is closed, a pawl supported to be rotatable around a second shaft member supported by the support member and restricting rotation of the latch in a second direction opposite to the first direction by engaging with the latch engaged with the striker, and an elastic member having one end portion and the other end portion and elastically deformed by an external force in a predetermined direction applied to the one end portion and the other end portion, in which in a state where the elastic member is elastically deformed, the one end portion engages with the pawl, the other end portion is supported by the support member, and an elastic force of the elastic member is applied to the pawl to bias the pawl to the latch side. The support member has a first support member made of a synthetic resin and a second support member made of a metal. The first support member has a first locking portion (a first engagement portion) to (with) which the other end portion of the elastic member is locked (engages). The second support member has a second locking portion (a second engagement portion) provided at a position separated in a direction in which the first locking portion receives the elastic force from the elastic member when viewed from the first locking portion.

In one aspect of this disclosure, the second support member may be an article obtained by press working.

In one aspect of this disclosure, the second shaft member may be made of a metal, the support member may further have a third support member made of a metal, one end portion of the second shaft member may be supported by the second support member, and the other end portion of the second shaft member may be supported by the third support member.

Usually, the other end portion of the elastic member is locked to the first locking portion of the first support member as described above. The first support member is made of a synthetic resin material and the manufacturing accuracy of the first support member is relatively high (as compared with, for example, an article obtained by press molding being performed on a metal plate). Accordingly, variations in the biasing force of the pawl spring can be suppressed. Here, the second locking portion of the second support member is disposed at a position separated in the direction of the elastic force that the first locking portion usually receives from the elastic member (direction opposite to the support reaction force) when viewed from the first locking portion. Even when the first locking portion of the first support member made of a synthetic resin is damaged as a result of impact application to the vehicle door, the other end portion of the elastic member is locked to the second locking portion insofar as the second locking portion made of a metal remains intact. Accordingly, the pawl is biased by the elastic member and a state where engagement/disengagement is possible with respect to the latch is maintained. Therefore, according to this disclosure, variations in the biasing force of the elastic member can be usually suppressed and it is possible to open/close the vehicle door as intended even in a case where the first locking portion is damaged.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A door lock device for a vehicle provided on a door of a vehicle, the vehicle door lock device comprising:

a support member;

a latch supported to be rotatable around a first shaft member supported by the support member and rotating in a predetermined first direction and engaging with a striker provided in a main body of the vehicle when the vehicle door is closed;

a pawl supported to be rotatable around a second shaft member supported by the support member and restricting rotation of the latch in a second direction opposite to the first direction by engaging with the latch engaged with the striker; and an elastic member having a first end portion and a second end portion and elastically deformed by an external force in a predetermined direction applied to the first end portion and the second end portion, in which in a state where the elastic member is elastically deformed, the first end portion engages with the pawl, the second end portion is supported by the support member, and an elastic force of the elastic member is applied to the pawl to bias the pawl to the latch side, wherein the support member has a first support member made of a synthetic resin and a second support member made of a metal, the first support member has a first engagement portion with which the second end portion of the elastic member engages, and the second support member has a second engagement portion provided at a position separated in a direction in which the first engagement portion receives the elastic force from the elastic member when viewed from the first engagement portion such that the second end portion of the elastic member is configured to engage with the second engagement portion when there is a loss of engagement with the first engagement portion.

2. The door lock device for a vehicle according to claim 1, wherein the second support member is an article obtained by press working.

3. The door lock device for a vehicle according to claim 1, wherein the second shaft member is made of a metal, the support member further has a third support member made of a metal, a first end portion of the second shaft member is supported by the second support member, and a second end portion of the second shaft member is supported by the third support member.

* * * * *